US008639172B2

(12) United States Patent
Izawa et al.

(10) Patent No.: US 8,639,172 B2
(45) Date of Patent: Jan. 28, 2014

(54) SHEET-FED DUPLEX AND SHEET-FED DUPLEX MULTI-COLOR PRINTERS

(75) Inventors: Hideo Izawa, Chiba (JP); Kenji Takahashi, Narashino (JP); Junichi Setoyama, Narashino (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 177 days.

(21) Appl. No.: 13/364,042

(22) Filed: Feb. 1, 2012

(65) Prior Publication Data

US 2012/0195659 A1 Aug. 2, 2012

(30) Foreign Application Priority Data

Feb. 1, 2011 (JP) ..... 2011-019980

(51) Int. Cl.
*G03G 21/00* (2006.01)

(52) U.S. Cl.
USPC ..... 399/343; 399/306; 399/309

(58) Field of Classification Search
USPC ..... 399/306, 308, 309, 343, 364
See application file for complete search history.

(56) References Cited

U.S. PATENT DOCUMENTS 4,688,925 A * 8/1987 Randall ..... 399/309
5,815,783 A * 9/1998 Lior et al. ..... 430/45.2

FOREIGN PATENT DOCUMENTS

JP 07-271107 10/1995

* cited by examiner

*Primary Examiner* — Hoang Ngo
(74) *Attorney, Agent, or Firm* — Cozen O'Connor

(57) ABSTRACT

A sheet-fed duplex and a sheet-fed duplex multi-color printer which is compact, using an electrophotographic printing system. For a long image to be printed on both faces of a sheet of paper, the printer enables producing printed matter at high efficiency and high precision, and yet when printing front and rear faces of a sheet of paper in succession the printer is able to prevent a printing face of the sheet of paper printed on upstream in its conveyance direction from becoming soiled by toner transferred from a printing face of the sheet of paper printed on downstream in its conveyance direction.

7 Claims, 5 Drawing Sheets

SHEET-FED DUPLEX AND SHEET-FED DUPLEX MULTI-COLOR PRINTERS

TECHNICAL FIELD

The present invention relates to a sheet-fed duplex and a sheet-fed duplex multi-color printer that is designed to effect printing on each of the front and rear faces of a sheet of paper in a single color or a plurality of colors, using electrophotographic printing units.

BACKGROUND ART

A machine for effecting printing, e.g., on one of the two faces of a sheet of paper in four colors, using a plurality of electrophotographic printing units is known as shown in JP H07-271107 A.

In such a printer using a plurality of electrophotographic printing units, a plurality of toner image forming units are arranged in a direction of conveyance of a sheet of paper. Each of the toner image forming units comprises a photoconductor drum as a image supporting member, a charging means for charging a surface of the photoconductor drum, an exposure means for exposing the surface of the photoconductor drum to form a latent image on the surface and a developing means for developing the latent image into a toner image, or the like. Toner images formed on the respective photoconductor drums in the toner image forming units are successively transferred onto the sheet of paper by means of a transfer means using a transfer conveyer belt with which the photoconductor drums in the respective toner image forming units are in rotational contact and the sheet of paper is conveyed.

In the conventional printer using a plurality of electrophotographic printers, a sheet of paper is successively conveyed on the transfer conveyer belt along a plurality of the successive toner image forming units. Then, while being conveyed across two adjacent toner image forming units, the sheet of paper is nipped to be applied with printing pressure in two areas at both end portions of the sheet of paper extending in its straight conveyance direction, giving rise to the problem that the accuracy in printing registration may be affected. In a multi-color printer to prevent this problem, the spacing between adjacent toner image forming units has been sized so that a sheet of paper after passing through a nip portion in a toner image forming unit is fed into that in a next toner image forming unit Also, a printer using an electrophotographic printing unit, development of an image onto a surface of a photoconductor drum and cleaning of the surface of the photoconductor drum having transferred the image can proceed always simultaneously. Thus, a sheet of paper can be printed with an image of a length in its conveyance direction regardless of a circular peripheral length of the photoconductor drum, and even with an image of a length exceeding the circular peripheral length of the photoconductor drum. If, however, sheets of paper are to be printed with such a long image, the spacing between adjacent toner image forming units must be of a size exceeding the maximum image size (length). As a result, the entire multi-color printer in which a plurality of the toner image forming units are interconnected must be correspondingly made longer in total size.

If in such a printer a sheet of paper is to be printed on its both, faces, a sheet of paper having been printed on its one face by one printing unit is reversed in printing face and then passed into a next, identical printing unit disposed adjacent thereto. If the sheet of paper is to be printed on its front and rear faces in four color, the length from the first toner image forming unit to the eighth toner image forming unit must be 7 (seven) times longer than an image size (length). The problem thus arises that the entire multi-color printer is made longer to allow printing an image that is long in the direction of conveyance of the sheet of paper.

Further, since the conventional printers adopt a belt conveyer system, there have been errors in sheet feed due to stretchability of the belt and limitations in accuracy arising from the structural phase of the belt conveyer system, which are more remarkable especially as the printing speed is to be increased. There have thus existed problems in maintaining high precision in printing registration in high speed sheet conveyance.

In view of the foregoing, it is an object of the present invention to provide a sheet-fed duplex and a sheet-fed duplex multi-color printer which is compact, using an electrophotographic printing system and which, if for a long image to be printed on both faces of a sheet of paper, allows producing a printed matter at high efficiency and high precision, and yet wherein in printing front and rear faces of a sheet of paper in succession the printer is able to prevent a printing face of the sheet of paper printed on upstream in its conveyance direction from becoming soiled by toner transferred from a printing face of the sheet of paper printed on downstream in its conveyance direction.

DISCLOSURE OF THE INVENTION

In order to achieve the object mentioned above, there is provided in accordance with the present invention a sheet-fed duplex printer which comprises: a pair of impression cylinders each provided on a peripheral surface thereof with a paper gripper for gripping a sheet of paper, one of the impression cylinders being in rotational contact with the other impression cylinder disposed downstream in a direction of rotation of and obliquely below the one impression cylinder, the two impression cylinders being synchronously rotated so that the regions of rotational contact thereof both move downwards, the sheet of paper reversing its printing face when the sheet of paper conveyed following a peripheral surface of the one impression cylinder is conveyed to follow that of the other impression cylinder; a first electrophotographic printing unit disposed opposite to a peripheral surface area of the one impression cylinder which area is upstream in the direction of rotation of the one impression cylinder from the region of rotational contact between the one and the other impression cylinder for printing on one face of the sheet of paper being conveyed following the peripheral surface of the one impression cylinder; a second electrophotographic printing unit disposed opposite to a peripheral surface area of the other impression cylinder which area is downstream in the direction of rotation of the other impression cylinder from the region of rotational contact between the one and the other impression cylinder for printing on the other face of the sheet of paper being conveyed following the peripheral surface of the other impression cylinder; and a cleaning unit disposed opposite to, and adapted to clean, a peripheral surface area of the other impression cylinder, the peripheral surface area of the other impression cylinder being downstream in the direction of its rotation from a position thereon at which the sheet of paper conveyed following the peripheral surface of the other impression cylinder is transferred therefrom downstream in the direction of conveyance of the sheet of paper.

There is also provided in accordance with the present invention a sheet-fed duplex multi-color printer which comprises a plurality of sheet-fed duplex printers such as set forth above which are arranged side by side in a direction of conveyance of the sheet of paper so that the other impression cylinder in the sheet-fed duplex printer at an upstream side is disposed in rotational contact with the one impression cylinder in the sheet-fed duplex printer at a downstream side; and a cleaning unit disposed opposite to, and adapted to clean, a peripheral surface area of the impression cylinder in each of said sheet-fed duplex printers, the peripheral surface of the impression cylinder being contacted by a printing face of the sheet of paper printed on upstream in the direction of conveyance of the sheet of paper, the peripheral surface area of the impression cylinder being downstream in the direction of its rotation from a position thereon at which the sheet of paper conveyed following the peripheral surface of the impression cylinder is transferred therefrom downstream in the direction of conveyance of the sheet of paper.

There is further provided in accordance with the present invention an alternative sheet-fed duplex multi-color printer which comprises at least two sheet-fed duplex two-color printers, the sheet-fed duplex two-color printer comprising: a pair of impression cylinders each provided on a peripheral surface thereof with a paper gripper for gripping a sheet of paper, one of the impression cylinders being in rotational contact with the other impression cylinder disposed downstream in a direction of rotation of and obliquely below the one impression cylinder; the two impression cylinders being synchronously rotated so that the regions of rotational contact thereof both move downwards, the sheet of paper reversing its printing face when the sheet of paper conveyed following a peripheral surface of the one impression cylinder is conveyed to follow that of the other impression cylinder; a first pair of electrophotographic printing units disposed opposite to peripheral surface areas of the one impression cylinder which areas are both upstream in the direction of rotation of the one impression cylinder from the region of rotational contact between the one and the other impression cylinder and are shifted in position from each other in the direction of rotation of the one impression cylinder for printing in two colors on one face of the sheet of paper being conveyed following the peripheral surface of the one impression cylinder; and a second pair of electrophotographic printing units disposed opposite to peripheral surface areas of the other impression cylinder which areas are both downstream in the direction of rotation of the other impression cylinder from the region of rotational contact between the one and the other impression cylinder and are shifted in position from each other in the direction of rotation of the other impression cylinder for printing in the two colors on the other face of the sheet of paper being conveyed following the peripheral surface of the other impression cylinder; wherein at least two the sheet-fed duplex two-color printers are arranged side by side in a direction of conveyance of the sheet of paper so that the other impression cylinder in a sheet-fed duplex two-color printer positioned upstream in the direction of conveyance of the sheet of paper and the one impression cylinder in a sheet-fed duplex two-color printer positioned downstream in the direction of conveyance of the sheet of paper are rotationally coupled with each other via a pair of bridge rollers which are disposed in rotational contact with each other and with the other and the one impression cylinder, respectively; wherein the sheet-fed duplex multicolor printer further comprises a cleaning unit disposed opposite to, and adapted to clean, a peripheral surface area of the impression cylinder in each of said sheet-fed duplex printers, the peripheral surface of the impression cylinder being contacted by a printing face of the sheet of paper printed on upstream in the direction of conveyance of the sheet of paper, the peripheral surface area of the impression cylinder being downstream in the direction of its rotation from a position thereon at which the sheet of paper conveyed following the peripheral surface of the impression cylinder is transferred therefrom down-stream in the direction of conveyance of the sheet of paper.

Further, in a sheet-fed duplex and a sheet-fed duplex multicolor printer as set forth above, the cleaning unit may include a cleaning roller in rotational contact with said impression cylinder, said cleaning roller and said impression cylinder having a potential difference applicable therebetween for electrophoretically removing toner adhered on the impression cylinder. Alternatively or in addition in a sheet-fed duplex and a sheet-fed duplex multicolor printer as set forth above, a peripheral surface of the impression cylinder to which the cleaning unit is opposite may have a surface treatment applied thereto with a material that prevents toner from adhering.

According to the sheet-fed duplex printer of the present invention, a sheet of paper is conveyed in the form of S character over from the impression cylinder upstream, to the impression cylinder downstream, in the sheet conveyance direction, making it possible to lengthen the path of sheet conveyance over and between the two impression cylinders while shortening the horizontal length of the printer to effect printing of the sheet of paper, and thus to make the printer compact.

Further, as use is made of electrophotographic printing units as means for printing of a sheet of paper, the output control of image data allows details of an image and the number of sheets of paper or the like to be freely controlled, making it possible to efficiently produce lots from large to small with a compact apparatus makeup. Also, like printing data are available, readiness time is made unnecessary, allowing the delivery of ordered products in a shortened time limit and highly improving the efficiency in operability. Further, the details of an image and the number of sheets of paper for an identical image can be made variable by digital printing in the course of continuous printing. It is also possible to meet with printing on demand and printing of sheets of paper sized from small to large.

According to the sheet-fed duplex multi-color printer using sheet-fed duplex printers as mentioned above, the entire apparatus despite being a multi-color printer can be shorted in total length, it is possible to achieve economical advantages such as space saving and reduction in apparatus cost.

Also, according to the alternative sheet-fed duplex multicolor printer mentioned above, it is possible for a sheet of paper to be printed on its both faces each in two colors with two impression cylinders, further reducing the apparatus makeup in length and rendering it compact.

And, in the sheet-fed duplex printer with the cleaning unit disposed opposite to, and adapted to clean, a peripheral surface are of the other impression cylinder which surface area is downstream in the direction of its rotation from a position at which the sheet of paper conveyed following the surface of the other impression cylinder is transferred therefrom downstream in the direction of conveyance of the sheet of paper, and in each of the sheet-fed duplex printers of the sheet-fed duplex multicolor printer with the cleaning unit disposed opposite to, and adapted to clean, a peripheral surface area of the impression cylinder which surface area is to be contacted by a printing face of the sheet of paper printed on upstream in the direction of conveyance of the sheet of paper in these sheet duplex printers and which surface area is downstream in the direction of its rotation from a position at which the sheet of paper conveyed following the surface of the impression cylinder is transferred therefrom downstream in the direction of conveyance of the sheet of paper, it is ensured that toner transferred from the printing surface of the sheet of paper printed on upstream in the direction of conveyance of the sheet of paper and adhered onto a peripheral surface of the impression cylinder contacted by that printing surface can be removed or cleaned for each rotation of the impression cylinder. It is thus possible to prevent a printing surface of the sheet of paper printed on upstream in the direction of its conveyance from becoming soiled by the toner adhered to a peripheral surface of the impression cylinder positioned downstream in the direction its conveyance. Accordingly, it is ensured that quality printed matters whose printed images are varied for each of printing surfaces by variable information can be produced at high quality.

BEST MODES FOR CARRYING OUT THE INVENTION

Mention is now made of one form of implementation of the present invention with reference to Drawing Figures.

Figure 1:
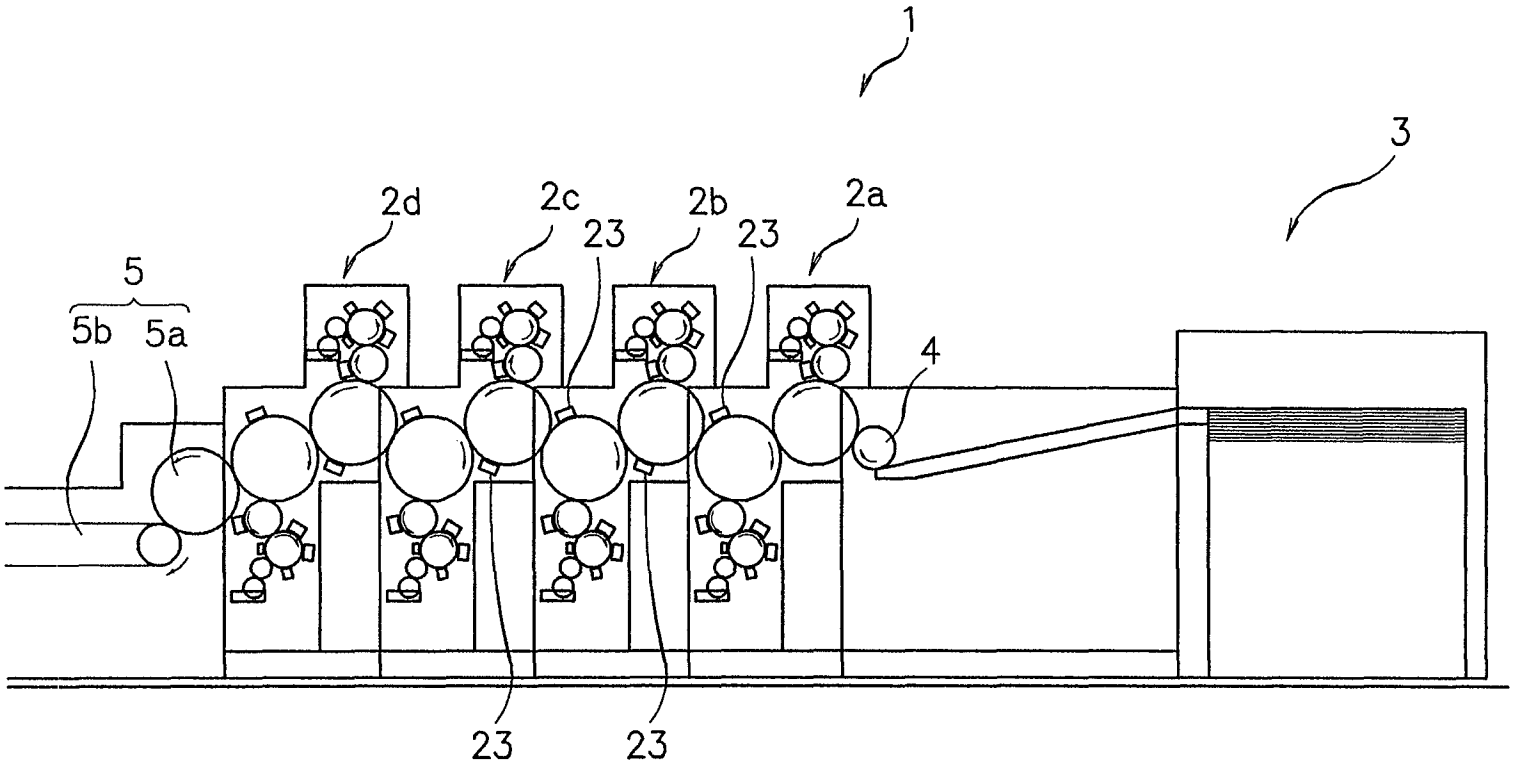
FIG. 1 is a structural explanatory view diagrammatically illustrating an embodiment of the sheet-fed duplex multi-color printer according to the present invention.

FIG. 1 is an explanatory view diagrammatically illustrating a sheet-fed duplex multi-color printer 1 constructed to print on the two faces of a sheet of paper, each in four colors. The sheet-fed duplex multi-color printer 1 is of the makeup that a first, a second, a third and a fourth sheet-fed duplex printer 2*a*, 2*b*, 2*c* and 2*d* are arranged side by side in a direction of conveyance of the sheet of paper so that its front and rear faces may be printed on successively as the sheet of paper is conveyed. And, the first sheet-fed duplex printer 2*a* at the most upstream side is provided at its inlet side with an inlet side bridge roller 4 for guiding the sheet of paper from a paper feeder 3, and the fourth sheet-fed duplex printer 2*d* at the most downstream side has an output unit 5 connected to its outlet side, the output unit comprising an outlet side bridge roller 5*a* and a delivery means 5*b*.

Figure 2:
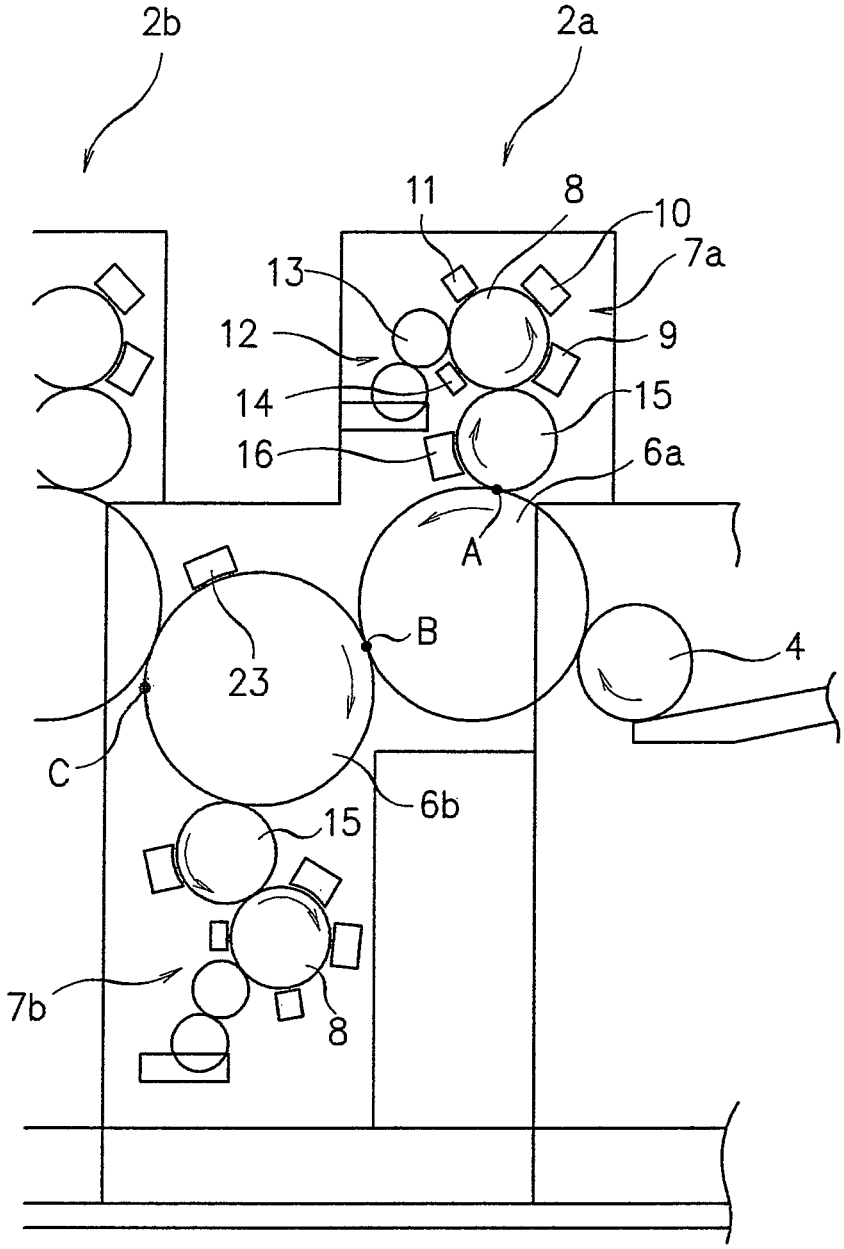
FIG. 2 is a structural explanatory view illustrating an embodiment of the sheet-fed duplex printer according to the present invention.

The sheet-fed duplex printers 2*a* to 2*d* are identical in makeup to each other and mention is made of their structure in respect of the first sheet-fed duplex printer 2*a* shown in FIG. 2.

Numerals 6*a* and 6*b* designate a first and a second impression cylinder having a diameter that is identical to each other. The second impression cylinder 6*b* is positioned downstream in the rotational direction of and obliquely below the first impression cylinder 6*a* and is in rotational contact with the first impression cylinder 6*a*. The first and second impression cylinders 6*a* and 6*b* are synchronously driven to rotate so that the regions of rotational contact thereof are both moved downwards.

The impression cylinders 6*a* and 6*b* are each provided on its peripheral surface with a paper gripper (not shown) for gripping a leading end portion of the sheet of paper fed from the rotational upstream side. When the impression cylinders 6*a* and 6*b* are rotated, the sheet of paper fed from upstream in rotational direction of the first impression cylinder 6*a* is first gripped by the paper gripper on the first impression cylinder 6*a* and conveyed following a peripheral surface of the first impression cylinder 6*a*. The sheet of paper drawn into between the first and second impression cylinders 6*a* and 6*b* in a region of their rotational contact is then gripped by the paper gripper on the second impression cylinder 6*b*, the sheet of paper then traveling following a peripheral surface of the second impression cylinder 6*b*. In the meantime, when the sheet of paper moves over from the peripheral surface of the first impression cylinder 6*a* to the peripheral surface of the second impression cylinder 6*b*, its printing surface is reversed from the front to the rear side.

A first electrophotographic printing unit 7*a* for front face printing is disposed opposite to a peripheral surface area of the first impression cylinder 6*a* which area is rotationally upstream of the region of rotational contact between the two impression cylinders 6*a* and 6*b*. And, a second electrophotographic printing unit 7*b* for rear face printing is disposed opposite to a peripheral surface area of the second impression cylinder 6*b* which area is rotationally downstream of the region of rotational contact between the two impression cylinders 6*a* and 6*b*.

The electrophotographic printing units 7*a* and 7*b* are basically identical in structure to each other except that the former and the latter are of a downwardly and an upwardly oriented structure, respectively. Mention is made below of their structure based on the electrophotographic printing unit for front face printing 7*a* which is of a downwardly oriented structure.

The electrophotographic printing unit 7*a* is generally identical in structure to one that is used as an ordinary electrophotographic printer, having a photoconductor drum 8. Around the photoconductor drum 8 over from its rotational upstream to downstream sides, there are arranged a photoconductor cleaning and de-charging or static eliminating unit 9, a charging unit 10, an exposure unit 11, a developing roller 13 in a developing unit 12, a carrier liquid eliminating unit 14, these units being opposite to the periphery of the photoconductor drum 8. The photoconductor drum 8 is in rotational contact with a transfer roller 15, which is in turn in rotational contact with the first impression cylinder 6*a*. Thus, a toner image developed on the peripheral surface of the photoconductor drum 8 by the developing roller 13 of the developing unit 12 is transferred via the transfer roller 15 onto the sheet of paper passing through a nip portion between the first impression cylinder 6*a* and the transfer roller 15. Note further that a transfer roller cleaning unit 16 is provided for the transfer roller 15.

As for the upwardly oriented electrophotographic printing unit 7*b* disposed at the underside of the second impression cylinder 6*b*, as in the downwardly oriented electrophotographic printing unit 7*a* a toner image transferred onto a transfer roller 15 from a photoconductor drum 8 is transferred onto the sheet of paper passing through a nip portion between the second impression cylinder 6*b* and the transfer roller 15.

In the sheet-fed duplex printer 2*a* made up as mentioned above, the sheet of paper fed from the inlet side bridge roller 4 of the paper feeder 3 to the impression cylinder 6*a* upstream in the direction thereof is wound on the first impression cylinder 6*a* and in that state is printed on its front face by the first electrophotographic printing unit 7*a*. Then, the sheet of paper is reversed in its printing side as it is wound on the second impression cylinder 6*b* and in that state is printed on its rear face by the second electrophotographic printing unit 7*b*. As a result, a sheet of paper passed through the first sheet-fed duplex printer 2*a* has an image printed on its both faces in one color.

The sheet-fed duplex printers 2*a* to 2*d* made up as mentioned above are arranged so that the first impression cylinder 6*a* in a downstream (downstream in the direction of conveyance of the sheet of paper) sheet-fed duplex printer is disposed in rotational contact with the second impression cylinder 6*b* of its immediately upstream (upstream in the direction of conveyance of the sheet of paper) sheet-fed duplex printer. Thus, a sheet of paper fed into the first sheet-fed duplex printer 2*a* will be printed on its both faces and each in four colors as it is successively passed through, and printed by, the sheet-fed duplex printers 2*a* to 2*d* and be lead out into the output unit 5.

In the successive sheet-fed duplex printers 2*a* to 2*d* in this case, a downstream positioned second impression cylinder 6*b* is positioned obliquely below its immediately upstream first impression cylinder 6*a* and a downstream positioned first impression cylinder 6*a* is positioned obliquely upwards of its immediately upstream second impression cylinder 6*b*. Thus, in the sheet-fed duplex multi-color printer 1 having the sheet-fed duplex mono-color printers 2*a* to 2*d* arranged as mentioned above, the impression cylinders are arranged zigzag as shown in FIG. 1 over the successive sheet-fed duplex printers 2*a* to 2*d*.

If mono-color printing of a sheet of paper is to be effected on its both faces using a single first sheet-fed duplex printer 2*a* alone, the second impression cylinder 6*b* may be provided with an output unit 5 comprising an outlet side bridge roller 5*a* and a delivery means 5*b*.

In the form of implementation mentioned above, each of the sheet-fed duplex printers 2*a* to 2*d* has two impression cylinders 6*a* and 6*b* disposed in rotational contact with each other. For example, when simplex printing is effected with the first impression cylinder 6*a* at the upstream side, the first impression cylinder 6*a* constitutes a feed cylinder, the second impression cylinder 6*b* constituting a bridge cylinder. And, the leading end of a sheet of paper on which printing is initiated by the electrophotographic printing unit 7*a* for the first impression cylinder 6*a* is fed from a point of printing initiation A in FIG. 2 with the rotation of the first impression cylinder 6*a* and taken over from a portion of rotational contact B between the first and second impression cylinders 6*a* and 6*b* to the second impression cylinder 6*b* for movement as the second impression cylinder 6*b* is rotated. In the meantime, the sheet of paper is printed on at the point A, and one face of the sheet of paper is printed on in the sheet-fed duplex printer 2*a* in such a way that when its leading end comes, e.g., to a position C, short of a portion of rotational contact between the second impression cylinder 6*b* in this sheet-fed duplex printer 2*a* and the first impression cylinder 6*a* in the succeeding sheet-fed duplex printer 2*b*, its trailing end passes through the point A.

Figure 3:
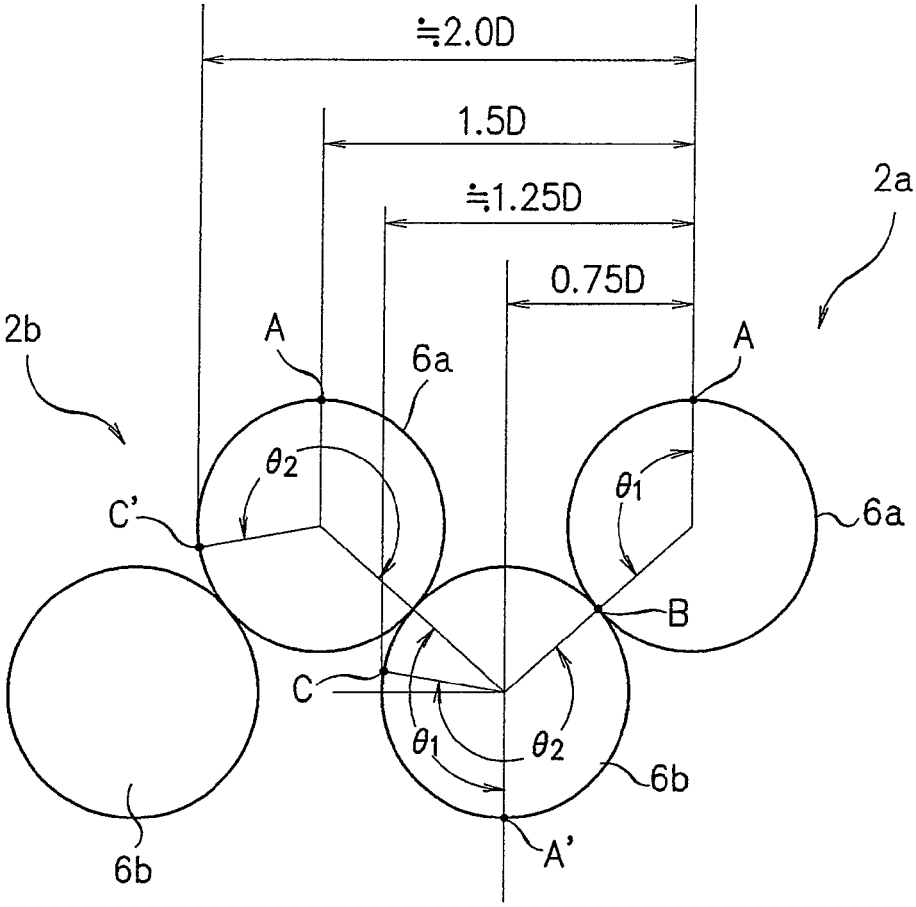
FIG. 3 is a diagrammatic view illustrating how one of the two faces of a sheet of paper is printed by a sheet-fed duplex printer.

Mention is made of an aspect of this one face printing with reference to a diagrammatic view shown in FIG. 3. Note here that the point of printing initiation A in this case is assumed to lie at a top, highest point, of the first impression cylinder 6*a*.

In FIG. 3, let it be assumed that the first and second impression cylinders 6*a* and 6*b* have a diameter of D, their axes are horizontally spaced apart at a distance of 0.75D and the sheet of paper has a length that is equal to a cylinders' peripheral length of πD. And, the leading end of the sheet of paper on which printing is initiated at the point A is moved with rotation of the first cylinder 6*a* by an angle of $\theta_1$ to reach a point B at which it is taken over to the second impression cylinder 6*b*. The leading end of the sheet of paper is further moved with rotation of the second impression cylinder 6*b* by an angle $\theta_2=(360°-\theta_1)$ to reach a point C at which time its trailing end is passed through the point A to complete the one face or simplex printing.

Then, with the inter-axial spacing between the impression cylinders 6*a* and 6*b* being 0.75D, it is seen that the angle $\theta_1$ is about 131.5 degrees, and with the length of the sheet of paper being equal to the peripheral length of the impression cylinder (360 degrees), it is seen that the angle $\theta_2$ between the points B and C is about 228.5 degrees. The position C at which the leading end of the sheet of paper then lies is positioned slightly (7 degrees) over from just beside of the second impression cylinder 6*b*. Thus, when the leading end of the sheet of paper is moved by a distance of about 1.25D horizontally, it follows that printing on one face of this sheet over its total length has been completed.

Figure 4:
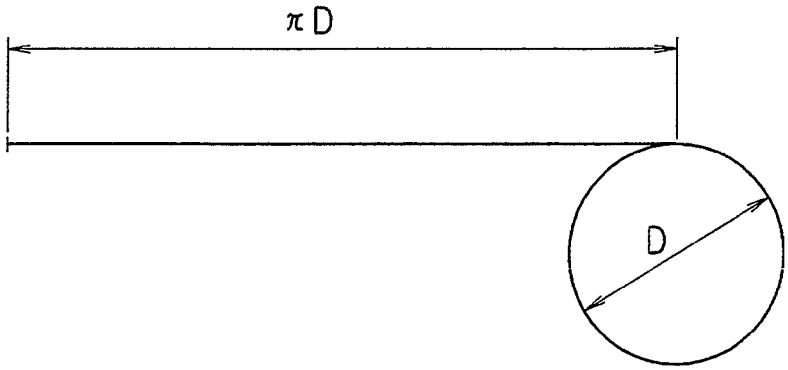
FIG. 4 is an explanatory view illustrating a distance of movement of a sheet of paper when one of its faces is printed with one impression cylinder.

FIG. 4 is an explanatory view illustrating a distance of movement of a sheet of paper when one face of the sheet having a length of πD is printed over its total length with one impression cylinder having a diameter of D. It is shown that movement of the sheet of paper by the distance πD makes the total length on its one face printed.

In contrast, the form of implementation shown in FIG. 3 allows one face of a sheet of paper having a length of πD to be printed on over the total length when the sheet of paper is moved by a distance of about 1.25D which is equal to about 1/2.5 of the distance of movement in the case shown in FIG. 4. Thus, in a printing apparatus in which one face of a sheet of paper having a length equal to a peripheral length of the impression cylinder is printed on over the total length, the apparatus can have a length equal to about 1/2.5 of that of the makeup shown in FIG. 4.

In the form of implementation illustrated, when the leading end of a sheet of paper comes, e.g., to a lowest point A' on the second impression cylinder 6*b*, the second electrophotographic printing unit 7*b* is driven to initiate printing on its rear face. The leading end of the sheet of paper is moved and taken over to the first impression cylinder 6*a* in the second sheet-fed duplex printer 2*b*. When it is further moved to come to a point C' after passing through a point A of the second front face printing initiation on the first impression cylinder 6*a*, the trailing end of the sheet of paper is passed through a point A' of rear face printing initiation. At this time, printing on the rear face will be completed.

In this way, a front and a rear face of a sheet of paper is printed on in the first sheet-fed duplex printer 2*a* by moving the sheet of paper from the point of front face printing initiation A horizontally by a distance that is equal to about twice the diameter D of the impression cylinders. And, an image of a second color on the front face is printed starting from the point of printing initiation A on the first impression cylinder 6*a* in the second sheet duplex printer 2*b* and an image of the second color on the rear face is printed starting from the point of printing initiation A' on the second impression cylinder 6*b* in the printer 2*b*. Printing of an image or images on the front and rear faces in succession is carried out by sheet duplex printers 2*c* and 2*d* downstream successively.

Figure 5:
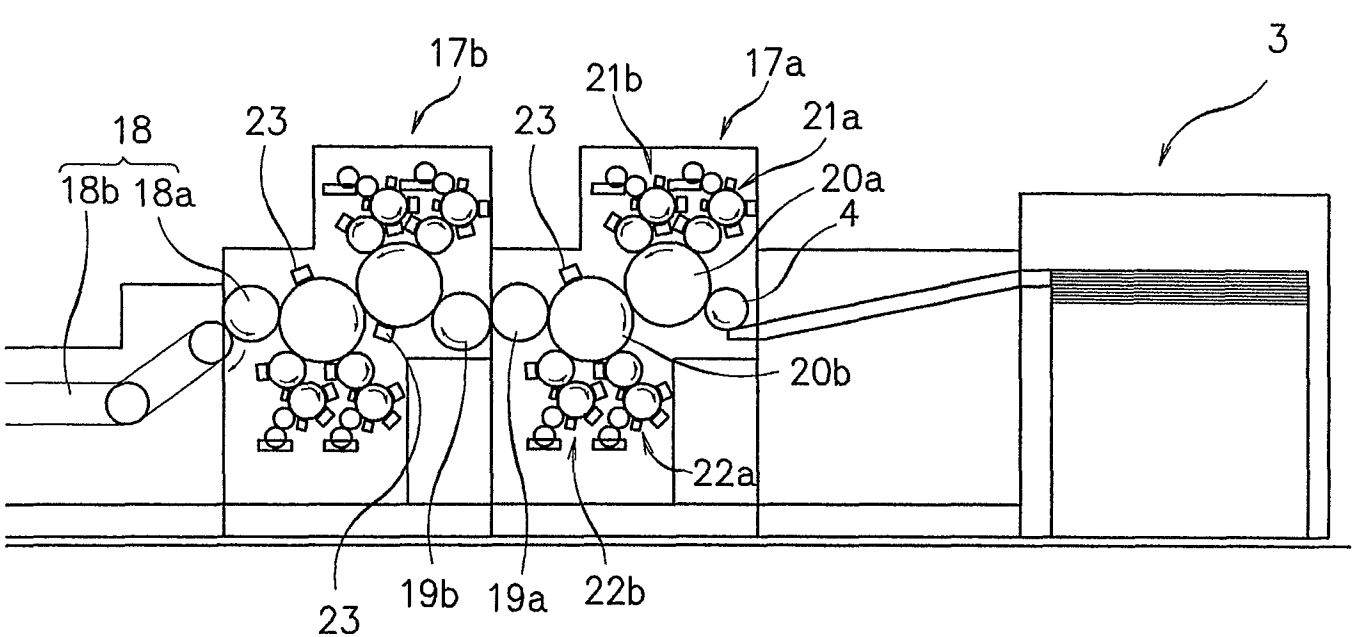
FIG. 5 is a structural explanatory view diagrammatically illustrating an alternative embodiment of the sheet-fed duplex multi-color printer according to the present invention.

FIG. 5 shows an alternative form of implementation of the present invention. A sheet-fed duplex multi-color printing apparatus 1' according to this form of implementation is made up having a first and a second sheet-fed duplex two-color printer 17*a* and 17*b* arranged side by side. And, the first sheet-fed duplex two-color printer 17*a* positioned upstream in a direction of conveyance of a sheet of paper is provided at its inlet side with an inlet side bridge roller 4 for guiding the sheet of paper from a paper feeder 3, and the second sheet-fed duplex two-color printer 17*b* at the downstream side is provided at its outlet side with an output unit 18 comprising a bridge roller 18*a* and a delivery means 18*b*. Also, the first and second sheet-fed duplex two-color printers 17*a* and 17*b* are interconnected via a first bridge roller 19*a* disposed at downstream side of one and a second bridge roller 19*b* disposed at upstream side of the other and driven in rotational contact with the first bridge roller 19*a*.

The first and second sheet-fed duplex two-color printers 17*a* and 17*b* are identical in structure to each other. Mention is made of their structure with respect to the first sheet-fed duplex two-color printer 17*a*.

There are shown a first and a second impression cylinder 20*a* and 20*b*, which are identical in diameter to each other. The second impression cylinder 20*b* is positioned downstream in a direction of rotation of and obliquely below the first impression cylinder 20*a* and is in rotational contact with the first impression cylinder 20*a*. The two impression cylinders 20*a* and 20*b* are synchronously driven to rotate so that the regions of the rotational contact thereof both move downwards.

The two impression cylinders 20*a* and 20*b* are each provided on a peripheral surface thereof with a paper gripper (not shown) for gripping a leading end portion of the sheet of paper fed from its upstream side in a direction of the rotation. When the two impression cylinders 20*a* and 20*b* are rotated, the sheet of paper fed from the upstream side in the direction of rotation of the first impression cylinder 20*a* is first gripped by the paper gripper on the first impression cylinder 20*a* for conveyance following a peripheral surface of the first impression cylinder 20*a*, and then gripped in a region of rotational contact between the first and second impression cylinders 20*a* and 20*b* by the paper gripper on the second impression cylinder 20*b* for conveyance following a peripheral surface of the second impression cylinder 20*b*. In the meantime, when the sheet of paper moves over from the peripheral surface of the first impression cylinder 20*a* to the peripheral surface of the second impression cylinder 20*b*, its printing surface is reversed from the front to the rear side Opposite to a peripheral surface area of the first impression cylinder 20*a* that is upstream of the region of rotational contact between the first and second impression cylinders 20*a* and 20*b* in the direction of rotation of the first impression cylinder 20*a*, there are disposed a pair of electrophotographic printing units 21*a* and 21*b* for front face printing which are shifted in positions in the direction of rotation of the first impression cylinder 20*a*. Opposite to a peripheral surface area of the second impression cylinder 20*b* that is downstream of the region of rotational contact between the first and second impression cylinders 20*a* and 20*b* in the direction of rotation of the second impression cylinder 20*b*, there are disposed a pair of electrophotographic printing units 22*a* and 22*b* for rear face printing which are shifted in position in the direction of rotation of the second impression cylinder 20*b*.

The electrophotographic printing units 21*a* and 21*b* for front face printing are each identical in structure to the electrophotographic printing unit for front face printing 7*a* shown in FIG. 2, and the electrophotographic printing units 22*a* and 22*b* for rear face printing are each identical in structure to the electrophotographic printing unit for rear face printing 7*b* shown in FIG. 2.

A sheet of paper supplied, as guided by the inlet side bridge roller 4, onto the rotating first impression cylinder 20*a* in the first sheet-fed duplex two-color printer 17*a* is carried thereby and printed on its front face in two colors by the two electrophotographic printing units for front face printing 21*a* and 21*b*. The sheet of paper printed on its front face in the two colors is then fed onto and carried by the rotating second impression cylinder 20*b* in the first sheet-fed duplex two-color printer 17*a* and printed on its rear face in two colors by the two electrophotographic printing units for rear face printing 22*a* and 22*b*. The sheet of paper printed on the front and rear faces each in the two colors in the first sheet-fed duplex two-color printer 17*a* is taken over to the second sheet-fed duplex two-color printer 17*b* via a first and a second bridge roller 19*a* and 19*b* and printed on the front and rear faces each in a third and a fourth color.

The sheet-fed duplex two-color printers 17*a*, 17*b* in this form of implementation of the invention are not limited to two in number, but three or four such printers may be used as arranged side by side.

Also, while in this form of implementation two electrophotographic printing units 21*a* and 21*b* are shown provided for each of the impression cylinders 20*a* and 20*b*, three or more printing units may be provided therefor.

In each of the forms of implementation as mentioned above, using as printing means an electrophotographic printing unit other than an offset rotary press with a printing plate mounted to a printing cylinder for printing allows forming an image from digital data on a photoconductor drum and cleaning of its surface after image formation to proceed simultaneously and in succession and hence allows printing of sheets of paper of sizes from small (short) to large (long) regardless of the circular peripheral length of a photoconductor drum.

Thus, unlike in the use of an offset press, if an image of a size approximating the circular peripheral length of an impression cylinder is to be printed, it is not essential that the photoconductor drum and transfer roller be constructed to be equal in diameter to the impression cylinder. Consequently, even for a printed matter of large size (long) the impression cylinder (feed cylinder) may be made up only having its circular peripheral length to be an essential circular peripheral length, and it is possible, too, to downsize the printing unit itself.

Also, the system used to convey a sheet of paper in the forms of implementation mentioned above is designed to convey and deliver while supporting and securing the sheet of paper upon gripping with a paper gripper provided on a surface of each of the two impression cylinders which function as a feed and bridge cylinder. With the sheet of paper being always secured in position with a paper gripper or grippers, it is possible to produce printed sheets of paper at high speed and high accuracy.

Each of the impression cylinder may be provided on a peripheral surface thereof with a plurality of paper grippers in a direction of its peripheral length in relation to the size (length) of an image to be printed and the peripheral length of the impression cylinders. Also, it is possible to use a selected number of grippers with unused grippers covered up with a covering member. Further, the bridge rollers 4*a*, 5*a*, 19*a* and 19*b* in a form of implementation as mentioned above may each be provided with a paper gripper or grippers as needed. Each of these rollers may be suitably altered in roller diameter to conform to the size of printing in a form of implementation as mentioned above.

In each of the aforementioned forms of implementation in which front and rear faces of a sheet of paper are alternately printed on by electrophotographic printing units, for example when printing on a front face of the sheet of paper conveyed on the first impression cylinder 6*a* by the printing unit 7*a* for front face printing is followed upon face reversal by printing on a rear face of the sheet of paper conveyed on the second impression cylinder 6*b* by the printing unit 7*b* for rear face printing, a transfer bias which develops between the transfer roller 15 in the rear surface printing unit 7*b* and the impression cylinder 6*b* tends to give rise to a phenomenon that a portion of toner of an image printed on the front face by the front face printing unit 7*a* is transferred and adhered onto a peripheral surface of the second impression cylinder 6*b* for the rear face printing.

In this case, if an image on the sheet front face contacting a peripheral surface of the second impression cylinder 6*b* is identical to that printed on a next sheet front surface on a peripheral surface of the first impression cylinder 6*a*, even supposing that the toner transferred and adhered is returned to the next sheet front face, it is unlikely that the return of the toner to an image position identical to that from which it was transferred causes soiling a sheet face with such toner transferred and adhered.

However, since as in the present invention, a printing image where electrophotographically printed with digital data can be varied by variable data for each of printing units, the toner transferred as mentioned above and then returned to a sheet face makes an appearance as a blot on an image and a non-image portion, leading to a deterioration in printing quality.

In order to solve problems as mentioned above, the present invention as shown in FIGS. 1, 2 and 5, includes an impression cylinder cleaning unit 23 disposed opposite to a peripheral surface area of an impression cylinder to be contacted by a printing face of a sheet of paper printed on by an electrophotographic printer positioned upstream in the direction of conveyance of the sheet of paper, the surface area of the peripheral surface of the rotating impression cylinder being downstream in the direction of its rotation from a position thereon at which the sheet of paper having finished printing by an electrophotographic printing unit disposed opposite to a peripheral surface area of the impression cylinder is transferred downstream, the cleaning unit being adapted to clean the peripheral surface area by removing toner transferred and adhered onto the peripheral surface area.

In the form of implementation shown in FIGS. 1 and 2, the peripheral surface of the first impression cylinder 6*a* is not contacted by and hence could not be spoiled by th printing face of the sheet of paper. Accordingly, in the first sheet duplex printer 2*a* there is disposed the impression cylinder cleaning unit 23 solely opposite to a peripheral surface area of the second rotating impression cylinder 6*b* being contacted by the printing face of sheet of paper printed on upstream, the peripheral surface area being downstream in the direction of its rotation from a position at which the sheet of paper is transferred.

On the other hand, in the second and the following sheet duplex printers 2*b*-2*d*, the cleaning unit 23 is disposed opposite to peripheral surface areas of both the impression cylinders 6*a*, 6*b*, the peripheral surface areas each being downstream in the direction of its rotation from the position of transfer of the sheet of paper.

In the form of implementation shown in FIG. 5, a cleaning unit 23 as in the foregoing forms of implementation is provided in opposition to a peripheral surface area of the second impression cylinder 20*b* in the first sheet-fed duplex printer 17*a* and peripheral surface areas of both impression cylinders 20*a*, 20*b* in the second sheet-fed duplex printer 17*b*, the peripheral surface areas each being downstream in the direction of its rotation from the position of transfer of the sheet of paper.

For the impression cylinder cleaning unit 23 mentioned above, use may be made of examples shown in FIGS. 6A, 6B, 6C and 6D. These embodiments will be described as opposite to the second impression cylinder 6*b*.

Figure 6A:
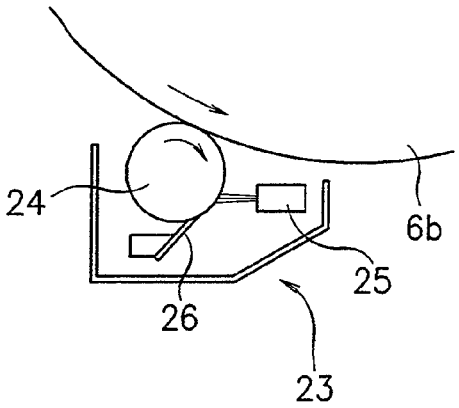
FIGS. 6A, 6B, 6C and 6D are diagrammatic explanatory views illustrating different embodiments of a cleaning unit for an impression cylinder.

One shown in FIG. 6A includes a cleaning roll 24 disposed in rotational contact with the impression cylinder 6*b*, a sprayer 25 for spraying a cleaning fluid onto the cleaning roll 24, and a blade 26 whereby toner transferred from the impression cylinder 6*b* to the cleaning roll 24 is scraped with the blade 26 in the presence of the cleaning fluid.

Figure 6B:
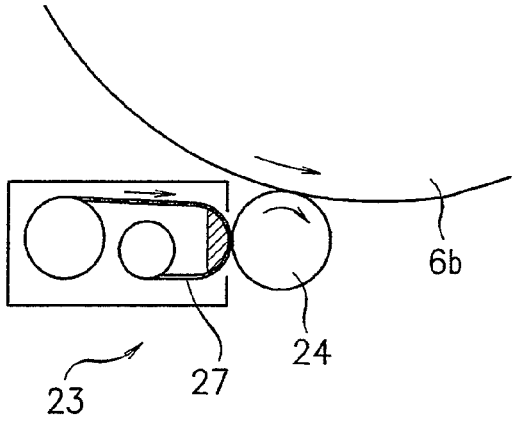

In the arrangement shown in FIG. 6B, the toner transferred to the cleaning roll 24 is removed therefrom by wiping the cleaning roller 24 with an unwoven fabric 27. In this case, the unwoven fabric is consecutively paid out and taken up so that a constantly fresh portion of the unwoven fabric 27 may rub against the cleaning roll 24.

Figure 6C:
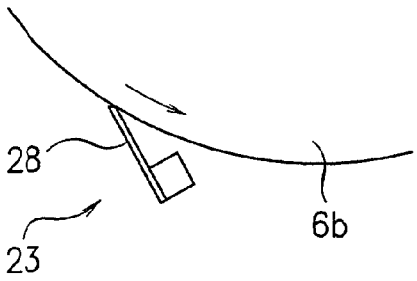
Figure 6D:
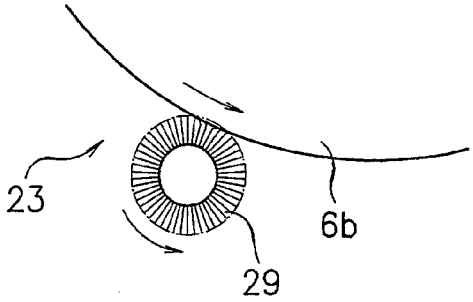

Also, the impression cylinder cleaning unit 23 may be embodied as one as shown in FIG. 6C in which a blade 28 is held in contact with the peripheral surface of the impression cylinder 6*b* while having a thin film of carrier liquid applied thereto, or as one as shown in FIG. 6D in which a rotary brush 29 is made in contact with the peripheral surface of the impression cylinder 6*b*.

In order to impede the transfer and attachment of toner to the peripheral surface of an impression cylinder as mentioned above, the peripheral surface of the impression cylinder may be coated with a material that prevents the toner from transferring and attaching to the peripheral surface of the impression cylinder, e.g., fluorocarbon resin or Teflon (registered Trademark), and further a ceramic. In this case, using such a surface treatment and the impression cylinder cleaning unit in combination is more effective.

Further, the impression cylinder cleaning unit 23 of the type in which the cleaning roller is disposed in rotational contact with the impression cylinder may be modified to increase its cleaning effect by applying a potential difference between the cleaning roller and the impression cylinder. In this case, setting the electric potentials of the impression cylinder and of the cleaning roller, e.g., at −1200 to −1400 V and around −2000 V, respectively, can facilitate the toner transfer. Naturally, rubber used as a composition of the cleaning roller should be one that is electrically conductive.

What is claimed is:

1. A sheet-fed duplex printer, comprising:

a pair of impression cylinders each provided on a peripheral surface thereof with a paper gripper for gripping a sheet of paper, one of the impression cylinders being in rotational contact with the other impression cylinder disposed downstream in a direction of rotation of and obliquely below the one impression cylinder, the two impression cylinders being synchronously rotated so that the regions of rotational contact thereof both move downwards, the sheet of paper reversing its printing face when the sheet of paper conveyed following the peripheral surface of the one impression cylinder is conveyed to follow that of the other impression cylinder;

a first electrophotographic printing unit disposed opposite to the peripheral surface area of the one impression cylinder which area is upstream in the direction of rotation of the one impression cylinder from the region of rotational contact between the one and the other impression cylinder for printing on one face of the sheet of paper being conveyed following the peripheral surface of the one impression cylinder;

a second electrophotographic printing unit disposed opposite to the peripheral surface area of the other impression cylinder which area is downstream in the direction of rotation of the other impression cylinder from the region of rotational contact between the one and the other impression cylinder for printing on the other face of the sheet of paper being conveyed following the peripheral surface of the other impression cylinder; and a cleaning unit disposed opposite to, and adapted to clean, the peripheral surface area of the other impression cylinder, the peripheral surface area of the other impression cylinder being downstream in the direction of its rotation from a position thereon at which the sheet of paper conveyed following the peripheral surface of the other impression cylinder is transferred therefrom downstream in the direction of conveyance of the sheet of paper.

2. A sheet-fed duplex printer as set forth in claim 1, wherein said cleaning unit includes a cleaning roller in rotational contact with said impression cylinder, said cleaning roller and said impression cylinder having a potential difference applicable therebetween for electrophoretically removing toner adhered onto the impression cylinder.

3. A sheet-fed duplex printer as set forth in claim 1, wherein a peripheral surface of the impression cylinder to which the cleaning unit is opposite has a surface treatment applied thereto with a material that prevents toner from adhering.

4. A sheet-fed duplex multi-color printer, comprising a plurality of sheet-fed duplex printers such as set forth in claim 1 which are arranged side by side in a direction of conveyance of the sheet of paper so that the other impression cylinder in said sheet-fed duplex printer at an upstream side is disposed in rotational contact with the one impression cylinder in said sheet-fed duplex printer at a downstream side; and a cleaning unit disposed opposite to, and adapted to clean, a peripheral surface area of the impression cylinder in each of said sheet-fed duplex printers, the peripheral surface of the impression cylinder being contacted by a printing face of the sheet of paper printed on upstream in the direction of conveyance of the sheet of paper, the peripheral surface area of the impression cylinder being downstream in the direction of its rotation from a position thereon at which the sheet of paper conveyed following the peripheral surface of the impression cylinder is transferred therefrom downstream in the direction of conveyance of the sheet of paper.

5. A sheet-fed duplex multicolor printer as set forth in claim 4, wherein said cleaning unit includes a cleaning roller in rotational contact with said impression cylinder, said cleaning roller and said impression cylinder having a potential difference applicable therebetween for electrophoretically removing toner adhered onto the impression cylinder.

6. A sheet-fed duplex printer as set forth in claim 4, wherein a peripheral surface of the impression cylinder to which the cleaning unit is opposite has a surface treatment applied thereto with a material that prevents toner from adhering.

7. A sheet-fed duplex multi-color printer, comprising at least two sheet-fed duplex two-color printers, the sheet-fed duplex two-color printer comprising:

a pair of impression cylinders each provided on a peripheral surface thereof with a paper gripper for gripping a sheet of paper, one of the impression cylinders being in rotational contact with the other impression cylinder disposed downstream in a direction of rotation of and obliquely below the one impression cylinder, the two impression cylinders being synchronously rotated so that the regions of rotational contact thereof both move downwards, the sheet of paper reversing its printing face when the sheet of paper conveyed following the peripheral surface of the one impression cylinder is conveyed to follow that of the other impression cylinder;

a first pair of electrophotographic printing units disposed opposite to the peripheral surface area of the one impression cylinder which areas are both upstream in the direction of rotation of the one impression cylinder from the region of rotational contact between the one and the other impression cylinder and are shifted in position from each other in the direction of rotation of the one impression cylinder for printing in two colors on one face of the sheet of paper being conveyed following the peripheral surface of the one impression cylinder; and a second pair of electrophotographic printing units disposed opposite to the peripheral surface area of the other impression cylinder which areas are both downstream in the direction of rotation of the other impression cylinder from the region of rotational contact between the one and the other impression cylinder and are shifted in position from each other in the direction of rotation of the other impression cylinder for printing in the two colors on the other face of the sheet of paper being conveyed following the peripheral surface of the other impression cylinder;

wherein at least two said sheet-fed duplex two-color printers are arranged side by side in a direction of conveyance of the sheet of paper so that the other impression cylinder in said sheet-fed duplex two-color printer positioned upstream in the direction of conveyance of the sheet of paper and the one impression cylinder in said sheet-fed duplex two-color printer positioned downstream in the direction of conveyance of the sheet of paper are rotationally coupled with each other via a pair of bridge rollers which are disposed in rotational contact with each other and with the other and the one impression cylinder, respectively;

wherein the sheet-fed duplex multi-color printer further comprises a cleaning unit disposed opposite to, and adapted to clean, the peripheral surface area of the impression cylinder in each of said sheet-fed duplex printers, the peripheral surface of the impression cylinder being contacted by a printing face of the sheet of paper printed on upstream in the direction of conveyance of the sheet of paper, the peripheral surface area of the impression cylinder being downstream in the direction of its rotation from a position thereon at which the sheet of paper conveyed following the peripheral surface of the impression cylinder is transferred therefrom downstream in the direction of conveyance of the sheet of paper.

* * * * *

UNITED STATES PATENT AND TRADEMARK OFFICE

CERTIFICATE OF CORRECTION

PATENT NO. : 8,639,172 B2
APPLICATION NO. : 13/364042
DATED : January 28, 2014
INVENTOR(S) : Hideo Izawa It is certified that error appears in the above-identified patent and that said Letters Patent is hereby corrected as shown below:

Title Page, Item (30), in the Foreign Application Priority Data

Now reads:

Feb. 1, 2011 (JP) 2011-019980

Should read:

Feb. 1, 2011 (JP) 2011-019880

Signed and Sealed this
Twenty-seventh Day of May, 2014

Michelle K. Lee

Michelle K. Lee
*Deputy Director of the United States Patent and Trademark Office*